US012157505B2

(12) United States Patent
Du et al.

(10) Patent No.: US 12,157,505 B2
(45) Date of Patent: Dec. 3, 2024

(54) SIDEWALL WINDOW STRUCTURE MODULE OF TRAIN, AND TRAIN

(71) Applicant: CRRC TANGSHAN CO., LTD., Hebei (CN)

(72) Inventors: Jianqiang Du, Tangshan (CN); Quanmei Guan, Tangshan (CN); Baolei Xu, Tangshan (CN); Zhaomei Wang, Tangshan (CN); Shujuan Chen, Tangshan (CN); Yuxi Yang, Tangshan (CN); Zhishen Li, Tangshan (CN); Likui Guo, Tangshan (CN)

(73) Assignee: CRRC TANGSHAN CO., LTD., Hebei (CN)

( * ) Notice: Subject to any disclaimer, the term of this patent is extended or adjusted under 35 U.S.C. 154(b) by 801 days.

(21) Appl. No.: 17/418,234

(22) PCT Filed: Jun. 12, 2019

(86) PCT No.: PCT/CN2019/090890

§ 371 (c)(1),
(2) Date: Jun. 24, 2021

(87) PCT Pub. No.: WO2020/133940

PCT Pub. Date: Jul. 2, 2020

(65) Prior Publication Data

US 2022/0111877 A1 Apr. 14, 2022

(30) Foreign Application Priority Data

Dec. 25, 2018 (CN) ..... 201811593961.2

(51) Int. Cl.
*B61D 25/00* (2006.01)
*B61D 17/08* (2006.01)

(52) U.S. Cl.
CPC ..... *B61D 25/00* (2013.01); *B61D 17/08* (2013.01)

(58) Field of Classification Search
CPC ..... B61D 17/00; B61D 17/06; B61D 17/08; B61D 25/00
See application file for complete search history.

(56) References Cited

U.S. PATENT DOCUMENTS 8,186,742 B2 5/2012 Narayana
9,657,489 B2 5/2017 Harper
(Continued)

FOREIGN PATENT DOCUMENTS

CN 102019937 A * 4/2011 ..... B61D 17/08
CN 201825118 U 5/2011
(Continued)

OTHER PUBLICATIONS

International Search Report in the international application No. PCT/CN2019/090890, mailed on Aug. 29, 2019.
(Continued)

*Primary Examiner* — Robert J McCarry, Jr.
(74) *Attorney, Agent, or Firm* — Syncoda LLC; Feng Ma

(57) ABSTRACT

Provided is a side wall window structure module of a train, the side wall window structure module comprising a window wallboard (100), supporting members shaped like the Chinese character "几" and reinforcing members shaped like the Chinese character "几", and stand columns (210) and supporting cross beams (311, 312, 313, 314) using the supporting members shaped like the Chinese character "几", wherein two flanging edges of each supporting member shaped like the Chinese character "几" are fixed on the inner side, facing the interior of the train, of the window wallboard (100); each reinforcing member shaped like the Chinese character "几" comprises a longitudinal reinforcing member (220) and a transverse reinforcing member (320); two flanging edges of each reinforcing member
(Continued)

shaped like the Chinese character "几" are fixed to one side edge of each supporting member shaped like the Chinese character "几"; and an arched high edge of each reinforcing member shaped like the Chinese character "几" is fixed to the other side edge of each supporting member shaped like the Chinese character "儿". Further provided is the train comprising the window structure module. The side wall window structure module of the train has a strong capacity in terms of buckling resistance.

18 Claims, 13 Drawing Sheets

(56) References Cited

U.S. PATENT DOCUMENTS

| | | | |
|---|---|---|---|
| 2011/0099913 | A1 | 5/2011 | Narayana |
| 2016/0362905 | A1 | 12/2016 | Harper |

FOREIGN PATENT DOCUMENTS

| | | | |
|---|---|---|---|
| CN | 202764986 | U | 3/2013 |
| CN | 203496905 | U | 3/2014 |
| CN | 203819244 | U | 9/2014 |
| CN | 105438198 | A | 3/2016 |
| CN | 106247155 | A | 12/2016 |
| CN | 107264554 | A | 10/2017 |
| CN | 206942529 | U | 1/2018 |
| CN | 207444634 | U | 6/2018 |

OTHER PUBLICATIONS

Written Opinion of the International Search Authority in the international application No. PCT/CN2019/090890, mailed on Aug. 29, 2019.

* cited by examiner

SIDEWALL WINDOW STRUCTURE MODULE OF TRAIN, AND TRAIN

CROSS-REFERENCE TO RELATED APPLICATIONS

The present application is a national stage of International Application No. PCT/CN2019/090890 filed on Jun. 12, 2019, which claims priority to Chinese patent application no. 201811593961.2 filed on Dec. 25, 2018. The disclosures of these applications are hereby incorporated by reference in their entirety.

TECHNICAL FIELD

The application relates to the technical field of electric trains, and particularly to a sidewall window structure assembly of a train, and a train.

BACKGROUND

With respect to a sidewall window structure assembly of a train, a Z-shaped upright post and a Z-shaped beam are usually used, and a transverse protruding edge of the Z-shaped structure is molten and welded to a window wallboard. Compressive and impact force is likely to twist and deform protruding edges of the Z-shaped structure or a side edge between the protruding edges to make relatively low the compression and impact resistance of the sidewall window structure assembly of the train and further make relatively low the buckling resistance of the sidewall window structure.

Therefore, relatively low buckling resistance of sidewall window structure assemblies of trains is a technical problem urgent to be solved by those skilled in the art.

The above information disclosed in BACKGROUND section is only used to strengthen an understanding to the background of the application, and thus may include information that does not form the related art known to those of ordinary skill in the art.

SUMMARY

Embodiments of the application provide a sidewall window structure assembly of a train and a train, to solve the technical problem of relatively low buckling resistance of sidewall window structure assemblies of trains.

The embodiments of the application provide a sidewall window structure assembly of a train, which may include a window wallboard, Ω-shaped supporting members and Ω-shaped reinforcing members.

Two protruding edges of the Ω-shaped supporting member are fixed to an inner side of the window wallboard.

Two protruding edges of the Ω-shaped reinforcing member are fixed to one side edge of the Ω-shaped supporting member, and an arched higher edge of the a-shaped reinforcing member is fixed to the other side edge of the Ω-shaped supporting member, to reinforce the Ω-shaped supporting member.

The inner side of the window wallboard may be the side, facing an interior of the train, of the window wallboard.

The embodiments of the application also provide a train, which may include the abovementioned sidewall window structure assembly.

With adoption of the above technical solutions, the embodiments of the application have the following technical effects.

When the protruding edge, fixed to the window wallboard, or arched higher edge of the Ω-shaped supporting member is subjected to compressive and impact forces, the compressive and impact forces may be dispersed because the Ω-shaped supporting member is of a symmetric structure, and in addition, the Ω-shaped reinforcing member is fixedly supported for reinforcement between the two side edges of the Ω-shaped supporting member, so that the Ω-shaped supporting member and the Ω-shaped reinforcing member may achieve relatively high compressive tension resistance as a whole, and are unlikely to be twisted and deformed, and furthermore, the sidewall window structure assembly of the train in the embodiments of the application is high in buckling resistance, and is unlikely to be twisted and deformed.

BRIEF DESCRIPTION OF THE DRAWINGS

The drawings described herein are adopted to provide a further understanding to the application and form a part of the application. Schematic embodiments of the application and descriptions thereof are adopted to explain the application and not intended to form improper limits to the application. In the drawings.

DRAWING REFERENCE SIGNS

100—a window wallboard;

210—upright post; 220—longitudinal reinforcing member;

311—first lower supporting beam; 312—first upper supporting beam; 313—second lower supporting beam; 314—second upper supporting beam; 320—transverse reinforcing member;

410—first side post; 420—second side post;

510—first anti-pressure reinforcing beam; 520—second anti-pressure reinforcing beam; 531—notch; and 532—curled edge.

DETAILED DESCRIPTION

In order to make the technical solutions and advantages in the embodiments of the application clearer, exemplary embodiments of the application will further be described below in combination with the drawings in detail. It is apparent that the described embodiments are not all but only part of embodiments of the application. It is to be noted that the embodiments in the application and characteristics in the embodiments may be combined without conflicts.

First Embodiment

Figure 1:
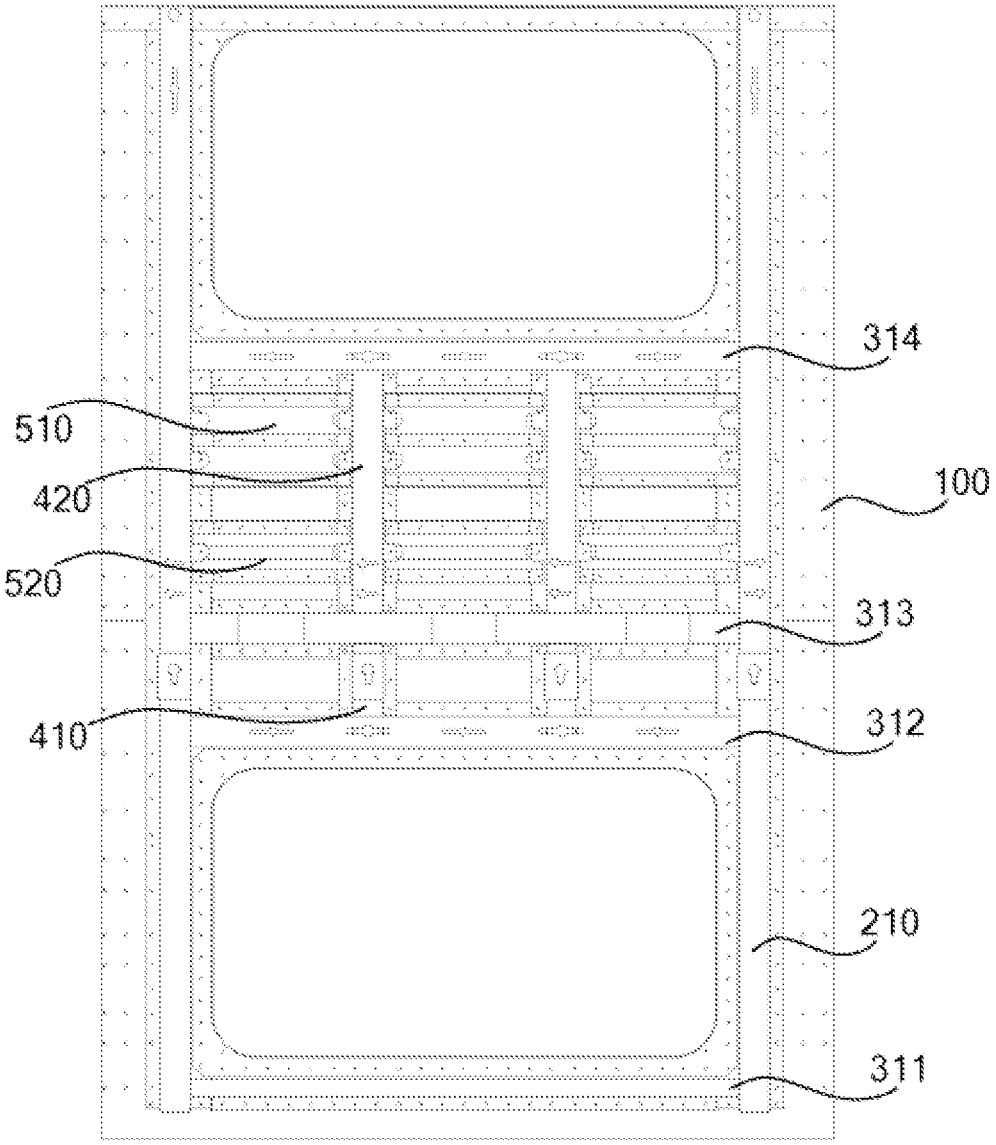
FIG. 1 is a schematic view of a sidewall window structure assembly of a train according to an embodiment of the application.
Figure 2:
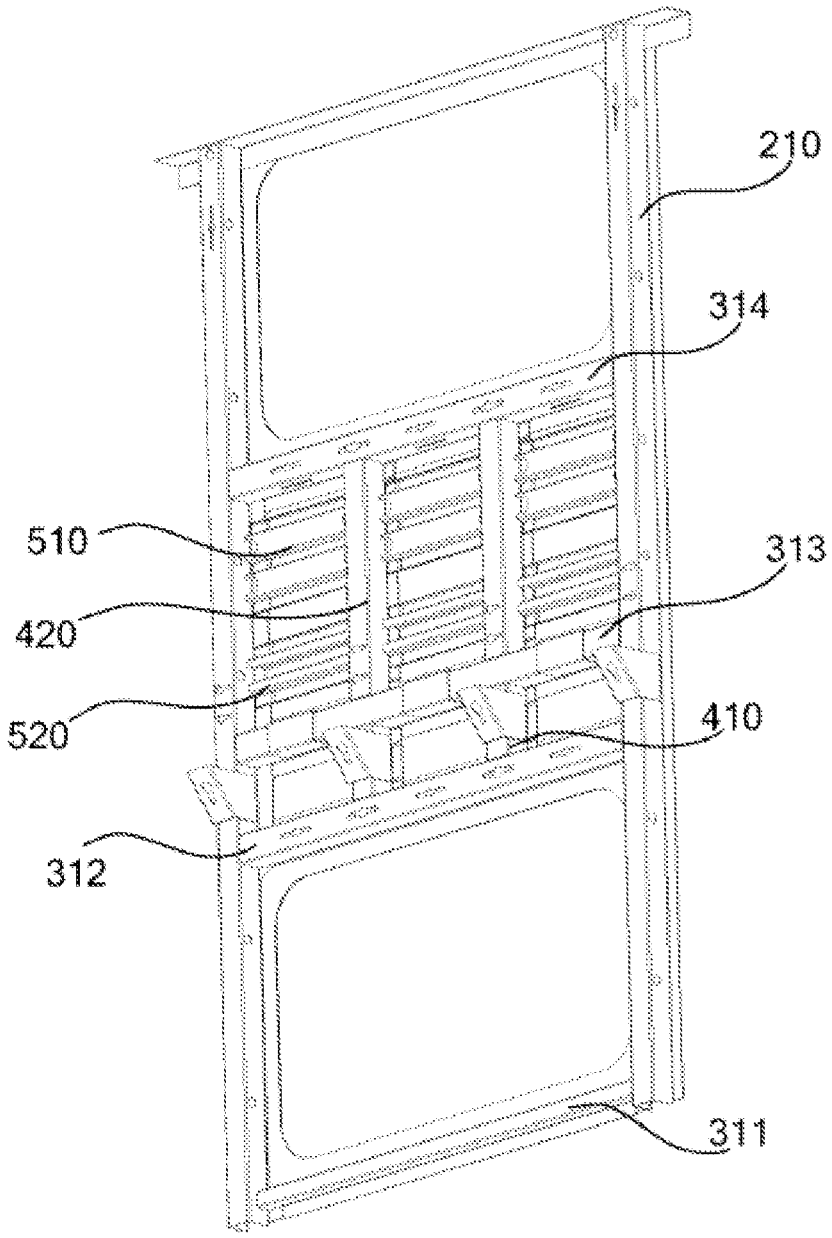
FIG. 2 is a schematic perspective view of the sidewall window structure assembly, shown in FIG. 1, wherein a window wallboard is removed.
Figure 3:
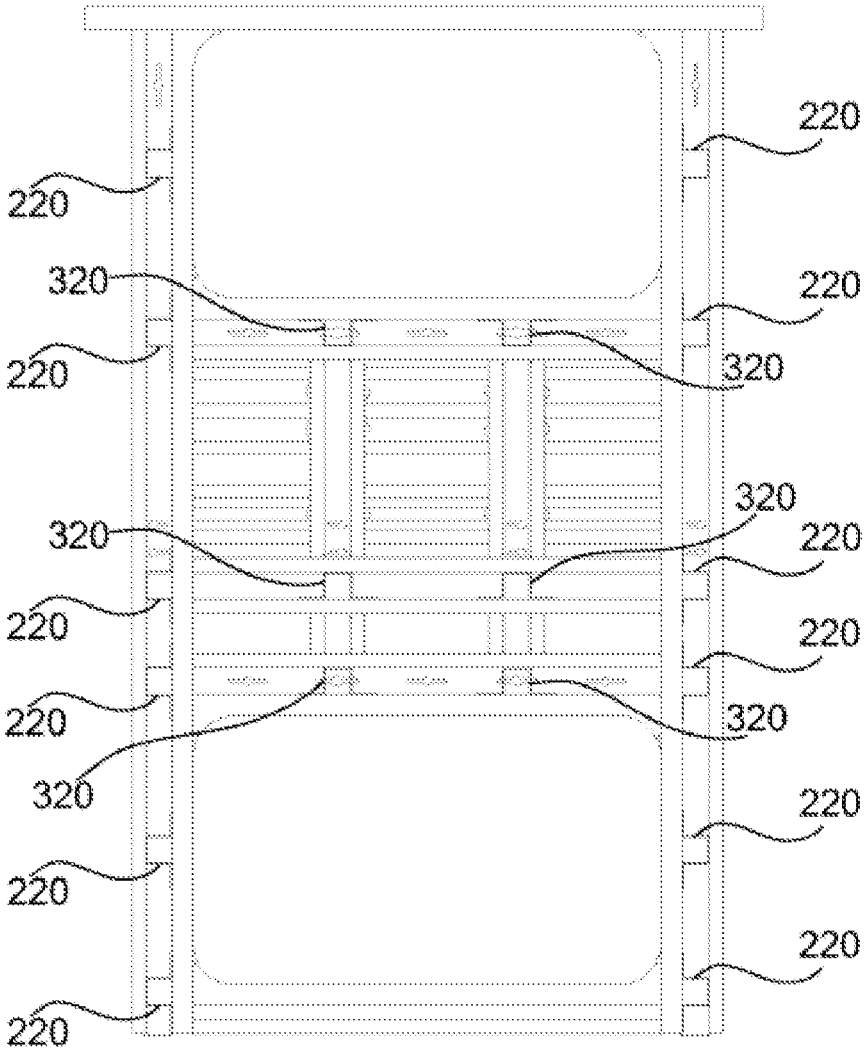
FIG. 3 is a schematic view of the side, facing a wallboard, of the sidewall window structure assembly in FIG. 2, wherein the window wallboard is removed.

FIG. 1 is a schematic view of a sidewall window structure assembly of a train according to an embodiment of the application. FIG. 2 is a schematic perspective view of the sidewall window structure assembly, shown in FIG. 1, of which a window wallboard is removed. FIG. 3 is a schematic view of the side, facing a wallboard, of the sidewall window structure assembly of which the window wallboard is removed in FIG. 2. As shown in FIG. 1, FIG. 2, and FIG. 3, the sidewall window structure assembly of the train in the embodiment of the application includes a window wallboard 100, Ω-shaped supporting members and Ω-shaped reinforcing members.

Two protruding edges of the Ω-shaped supporting member are fixed to an inner side of the window wallboard.

Two protruding edges of the Ω-shaped reinforcing member are fixed to one side edge of the Ω-shaped supporting member, and an arched higher edge of the a-shaped reinforcing member is fixed to the other side edge of the Ω-shaped supporting member, to reinforce the Ω-shaped supporting member.

The inner side of the window wallboard is the side, facing an interior of the train, of the window wallboard.

The sidewall window structure assembly of the train in the embodiment of the application includes the window wallboard, the Ω-shaped supporting members, and the Ω-shaped reinforcing members. The two protruding edges of the Ω-shaped supporting member are fixed to the inner side of the window wallboard. The two protruding edges of the Ω-shaped reinforcing member are fixed to one side edge of the Ω-shaped supporting member, and the arched higher edge of the Ω-shaped reinforcing member is fixed to the other side edge of the Ω-shaped supporting member, to reinforce the Ω-shaped supporting member. When the protruding edge, fixed to the window wallboard, or arched higher edge of the Ω-shaped supporting member is subjected to compressive and impact forces, the compressive and impact forces may be dispersed because the Ω-shaped supporting member is of a symmetric structure, and in addition, the Ω-shaped reinforcing member is fixedly supported for reinforcement between the two side edges of the Ω-shaped supporting member, so that the Ω-shaped supporting member and the Ω-shaped reinforcing member may achieve relatively high compressive tension resistance as a whole, and are unlikely to be twisted and deformed, and furthermore, the sidewall window structure assembly of the train in the embodiments of the application is high in buckling resistance, and is unlikely to be twisted and deformed.

Figure 4:
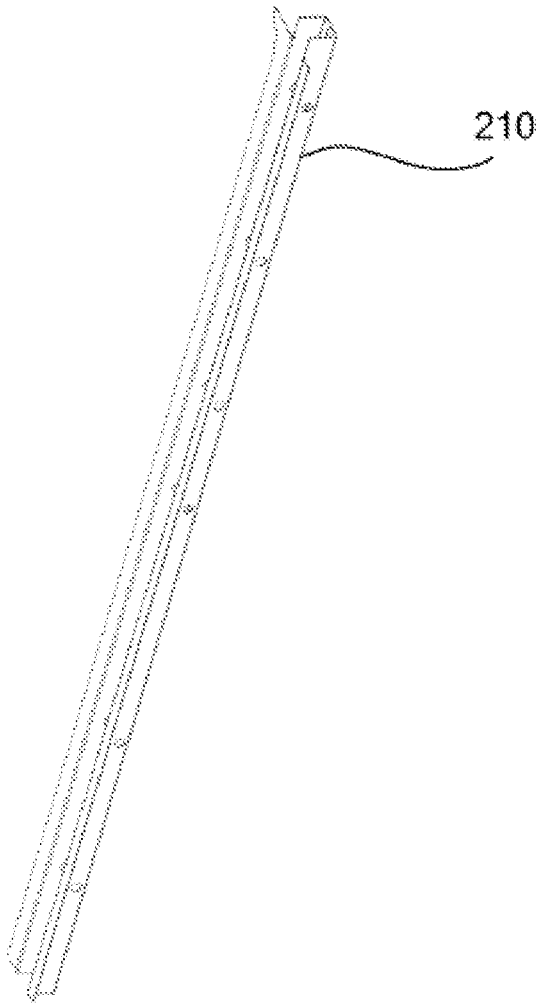
FIG. 4 is a schematic perspective view of an upright post of the sidewall window structure assembly shown in FIG. 1.

FIG. 4 is a schematic perspective view of an upright post of the sidewall window structure assembly shown in FIG. 1. During implementation, as shown in FIG. 4, the Ω-shaped supporting members include upright posts 210.

There are two upright posts 210. Transverse section of each upright post is a-shaped. One of the two upright posts 210 is located on one side of a window of the window wallboard, the other one of the upright posts is located on another side of a window of the window wallboard.

A structure of the upright post is symmetric with respect to a transverse direction, so that the compressive and impact forces may be dispersed, the longitudinal compressive tension resistance of the upright post is relatively high, and the upright post is unlikely to be twisted and deformed.

During implementation, as shown in FIG. 3, the Ω-shaped reinforcing members include longitudinal reinforcing members 220.

There are multiple longitudinal reinforcing members 220. An end face of each longitudinal reinforcing member 220 is Ω-shaped.

The longitudinal reinforcing members 220 are spaced apart from each other and fixed between two side edges of each upright post. Two protruding edges of the longitudinal reinforcing member are fixed to one side edge of the upright post, and a higher edge of the longitudinal reinforcing member is fixed to the other side edge of the upright post, to reinforce the upright post and improve the longitudinal force resistance property of the upright post.

Due to the existence of the longitudinal reinforcing members, when one side edge of the upright post is subjected to a longitudinal force, the longitudinal force is transmitted to the other side edge of the upright post under the action of the longitudinal reinforcing members to improve the longitudinal force resistance property of the upright post.

During implementation, the Ω-shaped supporting members further include supporting beams.

A longitudinal section of the supporting beam is Ω-shaped. The supporting beam is fixedly supported between the two upright posts.

A structure of the supporting beam is symmetric with respect to the longitudinal direction, so that the compressive and impact forces may be dispersed, the longitudinal compressive tension resistance of the supporting beam is relatively high, and the supporting beam is unlikely to be twisted and deformed.

During implementation, as shown in FIG. 3, the Ω-shaped reinforcing members include transverse reinforcing members 320.

There are multiple transverse reinforcing members 320. An end face of each transverse reinforcing member is Ω-shaped.

The transverse reinforcing members 320 spaced apart from each other and are fixed between two side edges of the supporting beam. Two protruding edges of the transverse reinforcing member are fixed to one side edge of the supporting beam, and a higher edge of the transverse reinforcing member is fixed to the other side edge of the supporting beam, to correct the deformation of the supporting beam generated during welding.

Due to the existence of the transverse reinforcing members, when the protruding edges of the supporting beam are welded, the action of a force generated by welding may be transmitted to the other side edge of the supporting beam under the action of the transverse reinforcing members to correct the deformation of the supporting beam generated during welding.

Figure 5:
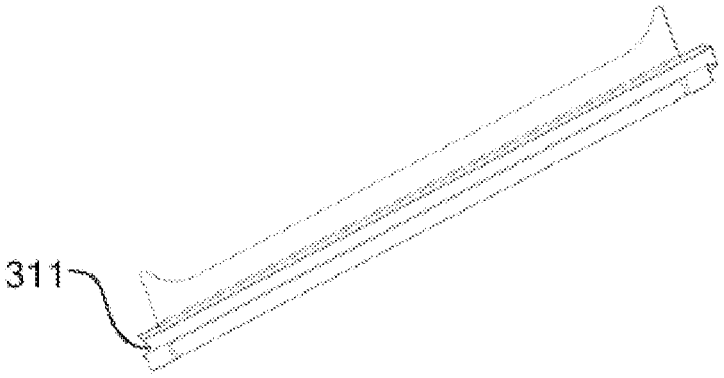
FIG. 5 is a schematic perspective view of a first lower supporting beam of the sidewall window structure assembly shown in FIG. 1.
Figure 6:
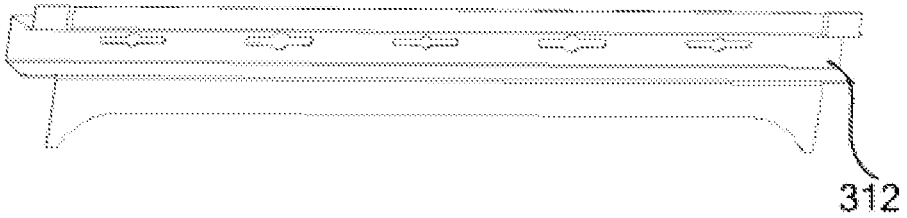
FIG. 6 is a schematic perspective view of a first upper supporting beam of the sidewall window structure assembly shown in FIG. 1.
Figure 7:
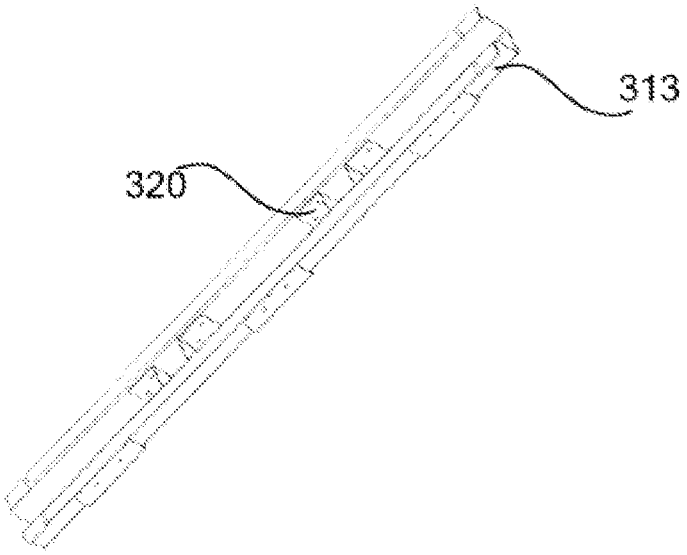
FIG. 7 is a schematic perspective view of a second lower supporting beam, fixed to transverse reinforcing members, of the sidewall window structure assembly shown in FIG. 1.
Figure 8:
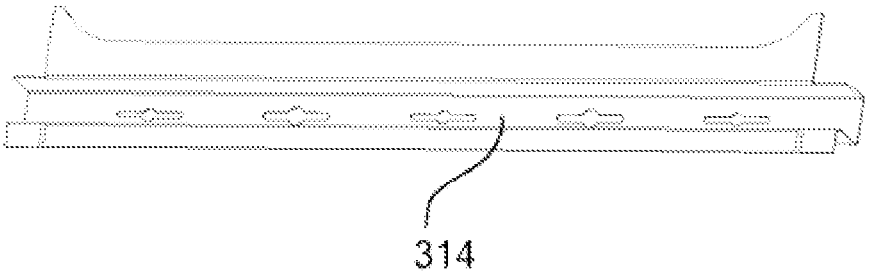
FIG. 8 is a schematic perspective view of a second upper supporting beam of the sidewall window structure assembly shown in FIG. 1.

FIG. 5 is a schematic perspective view of a first lower supporting beam of the sidewall window structure assembly shown in FIG. 1. FIG. 6 is a schematic perspective view of a first upper supporting beam of the sidewall window structure assembly shown in FIG. 1. FIG. 7 is a schematic perspective view of a second lower supporting beam of the sidewall window structure assembly shown in FIG. 1. FIG. 8 is a schematic perspective view of a second upper supporting beam of the sidewall window structure assembly shown in FIG. 1. During implementation, the supporting beams include a first lower supporting beam 311, a first upper supporting beam 312, a second lower supporting beam 313 and a second upper supporting beam 314.

As shown in FIG. 1, FIG. 2, and FIG. 5, the first lower supporting beam 311 is a supporting beam fixed below a lower window.

As shown in FIG. 1, FIG. 2, and FIG. 6, the first upper supporting beam 312 is a supporting beam fixed above the lower window.

As shown in FIG. 1, FIG. 2, and FIG. 7, the second lower supporting beam 313 is a supporting beam fixed at a position of a second floor of the window wallboard.

As shown in FIG. 1, FIG. 2, and FIG. 8, the second upper supporting beam 314 is a supporting beam fixed below an upper window.

The lower window is a window located at a lower position among two windows of the window wallboard. The upper window is a window located at an upper position among the two windows of the window wallboard.

The supporting beam provides a transverse supporting acting force, and in addition, the first lower supporting beam, the first upper supporting beam, the second lower supporting beam, and the second upper supporting beam are arranged to divide an area of the window wallboard into relatively small areas, so that the sidewall window structure assembly is relatively high in the compressive tension resistance, and is unlikely to be twisted and deformed.

Figure 9:
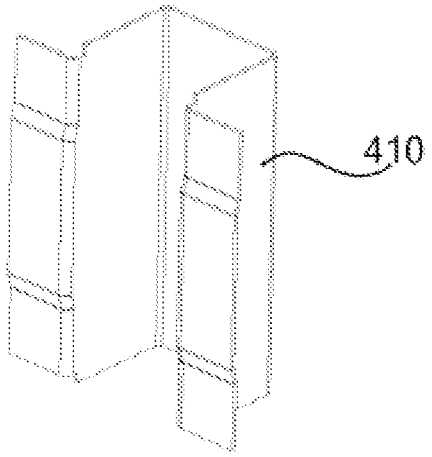
FIG. 9 is a schematic perspective view of a first side post of the sidewall window structure assembly shown in FIG. 1.

FIG. 9 is a schematic perspective view of a first side post of the sidewall window structure assembly shown in FIG. 1. During implementation, as shown in FIG. 1, FIG. 2, and FIG. 9, the sidewall window structure assembly further includes multiple first side posts 410.

Transverse section of each first side post 410 is Ω-shaped.

Each first side post 410 is fixedly supported between the first upper supporting beam and the second lower supporting beam, and two protruding edges of the first side post are fixed to the inner side of the window wallboard.

The first side post provides a longitudinal supporting acting force, and in addition, an area between the first upper supporting beam and the second lower supporting beam is divided into smaller areas, so that the sidewall window structure assembly is relatively high in compressive tension resistance, and is unlikely to be twisted and deformed.

Figure 10:
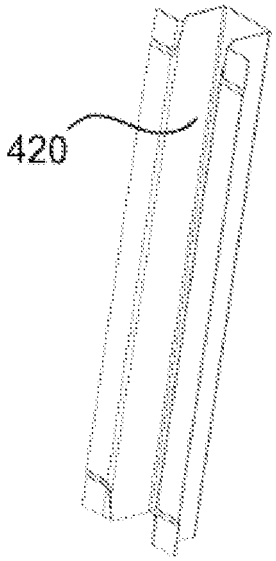
FIG. 10 is a schematic perspective view of a second side post of the sidewall window structure assembly shown in FIG. 1.

FIG. 10 is a schematic perspective view of a second side post of the sidewall window structure assembly shown in FIG. 1. During implementation, as shown in FIG. 1, FIG. 2, and FIG. 10, the sidewall window structure assembly further includes multiple second side posts 420.

A bottom surface of each second side post is Ω-shaped.

Each second side post 420 is fixedly supported between the second lower beam and the second upper beam, and two protruding edges of the second side post are fixed to the inner side of the window wallboard.

The second side post provides a longitudinal supporting acting force, and in addition, an area between the second lower beam and the second upper beam is divided into smaller areas, so that the sidewall window structure assembly is relatively high in compressive tension resistance, and is unlikely to be twisted and deformed.

Figure 11:
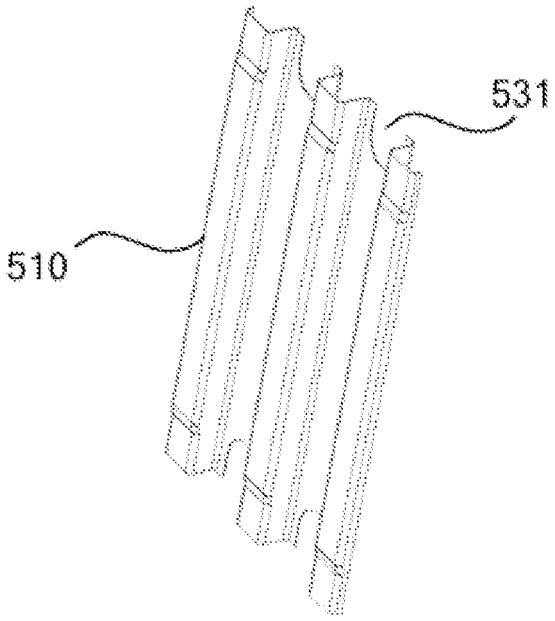
FIG. 11 is a schematic perspective view of a first anti-pressure reinforcing beam, of the sidewall window structure assembly shown in FIG. 1.
Figure 12:
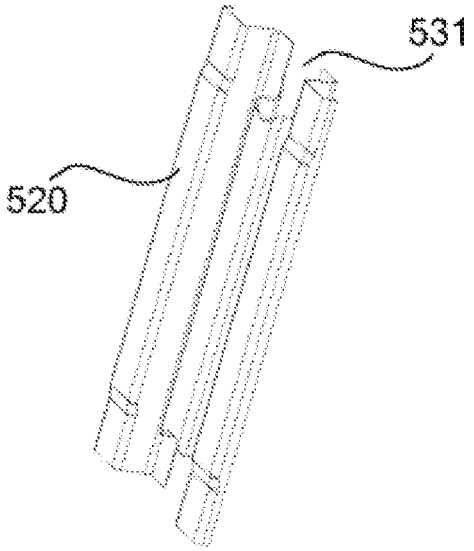
FIG. 12 is a schematic perspective view of a second anti-pressure reinforcing beam of the sidewall window structure assembly shown in FIG. 1.
Figure 13:
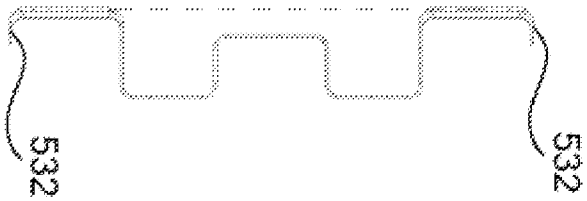
FIG. 13 is a longitudinal schematic view of a second anti-pressure reinforcing beam in FIG. 1.

FIG. 11 is a schematic perspective view of a first anti-pressure reinforcing beam of the sidewall window structure assembly shown in FIG. 1. FIG. 12 is a schematic perspective view of second anti-pressure reinforcing beam of the sidewall window structure assembly shown in FIG. 1. FIG. 13 is a longitudinal schematic view of a second anti-pressure reinforcing beam in FIG. 1. During implementation, as shown in FIG. 1, FIG. 2, FIG. 11, FIG. 12, and FIG. 13, the sidewall window structure assembly further includes multiple anti-pressure reinforcing beams.

A longitudinal section of each anti-pressure reinforcing beam is double-Ω-shaped.

Each anti-pressure reinforcing beam is fixed between two second side posts, and is fixed between the second side post and the upright post. Protruding edges at two ends of the anti-pressure reinforcing beam are fixed to the inner side of the window wallboard.

The anti-pressure reinforcing beam provides a transverse supporting acting force, and in addition, areas between the two second side posts and between the second side post and the upright post are divided into relatively small areas, so that the sidewall window structure assembly is relatively high in compressive tension resistance, and is unlikely to be twisted and deformed.

During implementation, as shown in FIG. 11 and FIG. 12, the two ends of the anti-pressure reinforcing beam have notches 531 configured as deformation allowances. The notch provides a space available for deformation of the anti-pressure reinforcing beam.

During implementation, as shown in FIG. 11 and FIG. 12, the protruding edge of the anti-pressure reinforcing beam is a thickened protruding edge, to improve the longitudinal compressive tension resistance.

During implementation, as shown in FIG. 11, FIG. 12, and FIG. 13, a curled edge 532 is formed at an end portion of each protruding edge of the anti-pressure reinforcing beam, to reduce the pressure, and improve the longitudinal compressive tension resistance.

During implementation, as shown in FIG. 11, the anti-pressure reinforcing beam includes a first anti-pressure reinforcing beam 510, of which a middle protruding edge is flush with protruding edges at two ends of the first anti-pressure reinforcing beam.

The middle protruding edge of the first anti-pressure reinforcing beam is fixed to the inner side of the window wallboard. The first anti-pressure reinforcing beam is fixed below the second upper beam.

Relatively small areas are divided by the three protruding edges of the first anti-pressure reinforcing beam, so that the sidewall window structure assembly is relatively high in compressive tension resistance, and is unlikely to be twisted and deformed.

During implementation, as shown in FIG. 12 and FIG. 13, the anti-pressure reinforcing beam includes a second anti-pressure reinforcing beam 520, a middle protruding edge of the second anti-pressure reinforcing beam is higher than two protruding edges at two ends respectively.

The second anti-pressure reinforcing beam is fixed below the first anti-pressure reinforcing beam.

Due to the structure of the anti-pressure reinforcing beam that the middle protruding edge is higher than the protruding edges at the two ends, when the higher edge of the anti-pressure reinforcing beam is subjected to a force, there is a relatively large room for elastic deformation of the middle protruding edge of the anti-pressure reinforcing beam, and the longitudinal compressive tension resistance is relatively high.

The anti-pressure reinforcing beam uses a section bar formed by pressing an ultra-thin sheet, and forms a closed chamber with the window wallboard by resistance spot welding, so that the rigidity of the sidewall window structure assembly is improved, and the buckling resistance of the sidewall window structure assembly is improved.

The black spots in FIG. 1 are welding spots formed by resistance spot welding. In the sidewall window structure assembly of the embodiment of the application, a resistance spot welding process is used a lot, a local fusion welding process is partially used, and the flatness of the window wallboard is relatively high.

Second Embodiment

A train of the embodiment of the application includes the sidewall window structure assembly as described in embodiment 1.

During implementation, the train further includes multiple Ω-shaped connecting beams.

A protruding edge of each Ω-shaped connecting beam extends across two adjacent window wallboards, and is fixed to the window wallboards to fixedly connect two sidewall window structure assemblies to one another.

As such, the two sidewall window structure assemblies are fixedly connected through the Ω-shaped connecting beams.

During implementation, the train further includes multiple anti-pressure connecting beams.

A longitudinal section of the each anti-pressure connecting beam is double-Ω-shaped. A protruding edge of each anti-pressure connecting beam extends across two adjacent window wallboards, and is fixed to the window wallboards to fixedly connect two sidewall window structure assemblies to one another.

As such, the two sidewall window structure assemblies are fixedly connected through the anti-pressure connecting beams.

During implementation, two ends of the anti-pressure connecting beam have notches configured to be deformation allowances. The notch provides a space available for deformation of the anti-pressure connecting beam.

During implementation, the protruding edge of the anti-pressure connecting beam is a thickened protruding edge, to improve the compressive tension resistance.

During implementation, a curled edge is formed at an end portion of each protruding edge of the anti-pressure connecting beam, to reduce the pressure, and improve the longitudinal compressive tension resistance.

During implementation, the anti-pressure connecting beam includes a first anti-pressure connecting beam, a middle protruding edge of the first anti-pressure connecting beam is flush with two protruding edges at two ends respectively. A structure of the first anti-pressure connecting beam is the same as the structure of the first anti-pressure connecting beam in FIG. 11.

The three protruding edges of the first anti-pressure reinforcing beam are fixed to two adjacent window wallboards.

Relatively small areas are divided by the three protruding edges of the first anti-pressure reinforcing beam, so that the train is relatively high in compressive tension resistance, and is unlikely to be twisted and deformed.

During implementation, the anti-pressure connecting beam includes a second anti-pressure connecting beam, a middle protruding edge of the second anti-pressure connecting beam is higher than two protruding edges at two ends respectively. A structure of the second anti-pressure connecting beam is the same as the structure of the second anti-pressure connecting beam in FIG. 12.

The two protruding edges at the two ends of the second anti-pressure reinforcing beam are fixed to two adjacent window wallboards.

Due to the structure of the anti-pressure connecting beam that the middle protruding edge is higher than the protruding edges at the two ends, when the higher edge of the anti-pressure connecting beam is subjected to a force, there is a relatively large room for elastic deformation of the middle protruding edge of the anti-pressure connecting beam, and the train is relatively high in compressive tension resistance, and is unlikely to be twisted and deformed.

The sidewall window structure assembly formed by the upright posts, the supporting beams, the longitudinal reinforcing members, the transverse reinforcing members, the first side posts, the second side posts, and the anti-pressure reinforcing beams uses a buckling-resistant sidewall window model structure, and forms a sidewall with another sidewall model, a sidewall roof rail, and a reinforcing accessory by assembly welding, to form the whole train with an underframe, a roof, and end wall components. Simulation requirements of a working condition of a compressive force of 3,569 kN and a working condition of a lateral impact force (178 kN) and train test requirements can be met.

In the descriptions of the application and the embodiments thereof, it is to be understood that orientation or position relationships indicated by terms "top", "bottom", "height", and the like are orientation or position relationships shown in the drawings, are adopted not to indicate or imply that indicated devices or components must be in specific orientations or structured and operated in specific orientations but only to conveniently describe the application and simplify descriptions, and thus should not be understood as limits to the application.

In the application and the embodiments thereof, unless otherwise definitely specified and limited, terms "arrange", "mount", "mutually connect", "connect", "fix" and the like should be broadly understood. For example, the terms may refer to fixed connection and may also refer to detachable connection or integration. The terms may refer to mechanical connection, may also refer to electrical connection, and may also refer to communication. The terms may refer to direct mutual connection, may also refer to indirect connection through a medium and may refer to communication in two components or an interaction relationship of the two components. Those of ordinary skill in the art may understand the specific meanings of the terms in the application according to specific conditions.

In the application and the embodiments thereof, unless otherwise expressly stated and defined, the state that a first feature is "above" or "below" a second feature may include that the first feature directly contacts with the second feature, or may include that the first and second features contact not directly but through another feature therebetween. Moreover, the state that the first feature is "above", "over" and "on" the second feature may include that the first feature is over and above the second feature, or only represents that a horizontal height of the first feature is greater than that of the second feature. The state that the first feature is "below", "under" and "underneath" the second feature may include that the first feature is under and below the second feature, or only represents that the horizontal height of the first feature is less than that of the second feature.

The above disclosure provides many different implementation modes or examples to implement different structures of the application. To simplify the disclosure of the application, components and arrangements in specific examples are described above. Of course, they are merely examples and not intended to limit the application. In addition, reference numbers and/or reference letters in the application can be repeated in different examples, and such repetitions are for purposes of simplicity and clarity, and do not indicate relationships between the discussed implementation modes and/or arrangements. Moreover, the application provides examples of various specific processes and materials, but those of ordinary skill in the art can realize applications of other processes and/or uses of other materials.

Although some optional embodiments of the application have been described, those skilled in the art, once learning about basic creative concepts, may make other variations and modifications to these embodiments. Therefore, it is intended that the appended claims are explained to include the optional embodiments and all the variations and modifications falling within the scope of the application.

It is apparent that those skilled in the art may make various modifications and transformations to the application without departing from the spirit and scope of the application. Therefore, if these modifications and transformations of the application fall within the scopes of the claims of the application and equivalent technologies thereof, the application is also intended to include these modifications and transformations.

The invention claimed is:

1. A sidewall window structure assembly of a train, comprising:

a window wallboard;

Ω-shaped supporting members, two protruding edges of the Ω-shaped supporting member being fixed to an inner side of the window wallboard; and Ω-shaped reinforcing members, two protruding edges of the Ω-shaped reinforcing member being fixed to one side edge of the Ω-shaped supporting member, and an arched higher edge of the Ω-shaped reinforcing member being fixed to the other side edge of the Ω-shaped supporting member, to reinforce the Ω-shaped supporting member, wherein the inner side of the window wallboard is the side, facing an interior of the train, of the window wallboard, wherein the Ω-shaped supporting members further comprise two upright posts and supporting beams;

a longitudinal section of each supporting beam is Ω-shaped, and each supporting beam is fixedly supported between the two upright posts, wherein the Ω-shaped reinforcing members comprise transverse reinforcing members;

there are multiple transverse reinforcing members, and an end face of each transverse reinforcing member is Ω-shaped;

the transverse reinforcing members spaced apart from each other are fixed between two side edges of the supporting beam; two protruding edges of the transverse reinforcing member are fixed to one side edge of the supporting beam, and a higher edge of the transverse reinforcing member is fixed to the other side edge of the supporting beam, to correct the deformation of the supporting beam generated during welding.

2. The sidewall window structure assembly of claim 1, wherein transverse section of each upright post is Ω-shaped, one of the upright posts is located on one side of a window of the window wallboard, the other one of the upright posts is located on another side of a window of the window wallboard.

3. The sidewall window structure assembly of claim 2, wherein the Ω-shaped reinforcing members comprise longitudinal reinforcing members;

there are multiple longitudinal reinforcing members, and an end face of each longitudinal reinforcing member is Ω-shaped;

the longitudinal reinforcing members are spaced apart from each other and are fixed between two side edges of each upright post; and two protruding edges of the longitudinal reinforcing member are fixed to one side edge of the upright post, and a higher edge of the longitudinal reinforcing member is fixed to the other side edge of the upright post, to reinforce the upright post and improve the longitudinal force resistance property of the upright post.

4. The sidewall window structure assembly of claim 1, wherein the supporting beams comprise:

a first lower supporting beam, which is a supporting beam fixed below a lower window;

a first upper supporting beam, which is a supporting beam fixed above the lower window;

a second lower supporting beam, which is a supporting beam fixed at a position of a second floor of the window wallboard; and a second upper supporting beam, which is a supporting beam fixed below an upper window, wherein the lower window is a window located at a lower position among two windows of the window wallboard, and the upper window is a window located at an upper position among the two windows of the window wallboard.

5. The sidewall window structure assembly of claim 4, further comprising:

multiple first side posts, wherein transverse section of each first side post is Ω-shaped; and each first side post is fixedly supported between the first upper supporting beam and the second lower supporting beam, and two protruding edges of the first side post are fixed to the inner side of the window wallboard.

6. The sidewall window structure assembly of claim 5, further comprising:

multiple second side posts, wherein transverse section of each second side post is Ω-shaped; and each second side post is fixedly supported between the second lower supporting beam and the second upper supporting beam, and two protruding edges of the second side post are fixed to the inner side of the window wallboard.

7. The sidewall window structure assembly of claim 6, further comprising:

multiple anti-pressure reinforcing beams, wherein a longitudinal section of each anti-pressure reinforcing beam is double-Ω-shaped;

each anti-pressure reinforcing beam is fixed between two second side posts, and is fixed between the second side post and the upright post; and protruding edges at two ends of the anti-pressure reinforcing beam are fixed to the inner side of the window wallboard.

8. The sidewall window structure assembly of claim 7, wherein each protruding edge of the anti-pressure reinforcing beam is a thickened protruding edge, to improve the longitudinal compressive tension resistance.

9. The sidewall window structure assembly of claim 8, wherein a curled edge is formed at an end portion of each protruding edge of the anti-pressure reinforcing beam, to reduce the pressure and improve the longitudinal compressive tension resistance.

10. The sidewall window structure assembly of claim 9, wherein the anti-pressure reinforcing beam comprises a first anti-pressure reinforcing beam, a middle protruding edge of the first anti-pressure reinforcing beam is flush with protruding edges at two ends respectively; and the middle protruding edge of the first anti-pressure reinforcing beam is fixed to the inner side of the window wallboard, the first anti-pressure reinforcing beam is fixed below the second upper beam.

11. The sidewall window structure assembly of claim 9, wherein the anti-pressure reinforcing beam comprises a second anti-pressure reinforcing beam, a middle protruding edge of the second anti-pressure reinforcing beam is higher than two protruding edges at two ends respectively; and the second anti-pressure reinforcing beam is fixed below the first anti-pressure reinforcing beam.

12. A train, comprising a sidewall window structure assembly, wherein the sidewall window structure assembly comprises:

a window wallboard;

Ω-shaped supporting members, two protruding edges of the Ω-shaped supporting member being fixed to an inner side of the window wallboard; and Ω-shaped reinforcing members, two protruding edges of the Ω-shaped reinforcing member being fixed to one side edge of the Ω-shaped supporting member, and an arched higher edge of the Ω-shaped reinforcing member being fixed to the other side edge of the Ω-shaped supporting member, to reinforce the Ω-shaped supporting member, wherein the inner side of the window wallboard is the side, facing an interior of the train, of the window wallboard, wherein the Ω-shaped supporting members further comprise two upright posts and supporting beams;

a longitudinal section of each supporting beam is Ω-shaped, and each supporting beam is fixedly supported between the two upright posts, wherein the Ω-shaped reinforcing members comprise transverse reinforcing members;

there are multiple transverse reinforcing members, and an end face of each transverse reinforcing member is Ω-shaped;

the transverse reinforcing members spaced apart from each other are fixed between two side edges of the supporting beam; two protruding edges of the transverse reinforcing member are fixed to one side edge of the supporting beam, and a higher edge of the transverse reinforcing member is fixed to the other side edge of the supporting beam, to correct the deformation of the supporting beam generated during welding.

13. The train of claim 12, further comprising:

multiple Ω-shaped connecting beams, wherein an protruding edge of each Ω-shaped connecting beam extends across two adjacent window wallboards, and is fixed to the window wallboards to fixedly connect two sidewall window structure assemblies to one another.

14. The train of claim 12, further comprising:

multiple anti-pressure connecting beams, wherein a longitudinal section of each anti-pressure connecting beam is double-Ω-shaped; and an protruding edge of each anti-pressure connecting beam extends across two adjacent window wallboards, and is fixed to the window wallboards to fixedly connect two sidewall window structure assemblies to one another.

15. The train of claim 14, wherein a middle protruding edge of the anti-pressure connecting beam is a thickened protruding edge.

16. The train of claim 15, wherein a curled edge is formed at an end portion of the middle protruding edge of the anti-pressure connecting beam.

17. The train of claim 16, wherein the anti-pressure connecting beam comprises a first anti-pressure connecting beam, a middle protruding edge of the first anti-pressure connecting beam is flush with two protruding edges at two ends respectively; and the three protruding edges of the first anti-pressure connecting beam are fixed to two adjacent window wallboards.

18. The train of claim 16, wherein the anti-pressure connecting beam comprises a second anti-pressure connecting beam, a middle protruding edge of the second anti-pressure connecting beam is higher than protruding edges at two ends respectively; and the two protruding edges at the two ends of the second anti-pressure connecting beam are fixed to two adjacent window wallboards.

* * * * *